United States Patent [19]

Nelson

[11] 4,147,380

[45] Apr. 3, 1979

[54] CONTINUOUS FLEXIBLE HINGE FOR PAPERBOARD AND THE LIKE

[75] Inventor: Douglas G. Nelson, Centerville, Ohio

[73] Assignee: The Mead Corporation, Dayton, Ohio

[21] Appl. No.: 804,787

[22] Filed: Jun. 8, 1977

[51] Int. Cl.[2] ..... B42D 3/06

[52] U.S. Cl. ..... 281/29; 156/257; 156/259; 156/512; 156/517; 428/58; 428/167

[58] Field of Search ..... 281/29; 156/257, 259, 156/324, 512, 517; 428/58, 167, 122

[56] References Cited

U.S. PATENT DOCUMENTS

| | | | |
|---|---|---|---|
| 256,022 | 4/1882 | Megee | 281/24 |
| 281,101 | 7/1883 | Megee | 281/24 |
| 444,821 | 1/1891 | Feister | 156/517 |
| 454,003 | 6/1891 | Jewett | 281/15 R |
| 921,873 | 5/1909 | McKibbin | 281/35 |
| 1,158,180 | 10/1915 | Cohn | 83/346 |
| 1,495,467 | 5/1924 | String | 281/37 |
| 1,908,109 | 5/1933 | Bolton | 260/284 |
| 1,913,969 | 6/1933 | Wood | 281/23 |
| 2,051,908 | 8/1936 | Schade | 281/29 |
| 2,166,038 | 7/1939 | Chambon | 156/479 |
| 2,250,533 | 7/1941 | Hanson | 156/259 |
| 2,339,586 | 1/1944 | Roberts | 281/29 |
| 2,390,125 | 12/1945 | Schade | 281/29 |
| 2,486,330 | 10/1949 | Schade | 295/21 |
| 2,505,743 | 4/1950 | Rose | 281/29 |
| 2,554,298 | 5/1951 | Ferguson | 225/96 |
| 2,556,787 | 6/1951 | Bach | 156/363 |
| 2,621,138 | 12/1952 | Messing | 3/363 |
| 2,641,484 | 6/1953 | Brody | 281/34 |
| 2,656,551 | 10/1953 | Bunch | 11/2 |
| 2,726,975 | 12/1955 | Hoag | 156/259 |
| 2,739,635 | 3/1956 | Searborne | 156/253 |
| 2,772,427 | 12/1956 | Rankin | 402/75 |
| 2,922,172 | 1/1960 | Boyle | 156/16 |
| 2,970,634 | 2/1961 | Hantscho | 156/202 |
| 2,977,271 | 3/1961 | Lutwack | 148/12.7 R |
| 3,145,033 | 8/1964 | Caddoo | 76/27 |
| 3,168,424 | 2/1965 | Sandor | 156/244.19 |
| 3,195,924 | 7/1965 | Carter | 281/29 |
| 3,199,896 | 8/1965 | Caddoo | 281/29 |
| 3,204,986 | 9/1965 | Tooker | 281/29 |
| 3,206,226 | 9/1965 | Boyle | 281/29 |
| 3,206,349 | 9/1965 | Boyle | 280/47.31 |
| 3,228,709 | 1/1966 | Tooker | 177/170 |
| 3,271,051 | 9/1966 | Mullen et al. | 281/29 |
| 3,271,051 | 9/1966 | Mullen | 281/29 |
| 3,273,913 | 9/1966 | Mullen | 281/29 |
| 3,318,618 | 5/1967 | Mullen | 281/29 |
| 3,476,406 | 11/1969 | Mullen | 281/29 |
| 3,834,972 | 9/1974 | Sava | 156/517 |

FOREIGN PATENT DOCUMENTS

| | | |
|---|---|---|
| 1041118 | 10/1953 | France. |
| 718964 | 12/1954 | United Kingdom. |
| 796063 | 6/1958 | United Kingdom. |

*Primary Examiner*—J. M. Meister

[57] ABSTRACT

A continuous flexible hinge for paperboard and the like, suitable for use in making book cover blanks, is skived in the region beneath the hinge tape to a depth equal to the thickness of the tape. The hinge tape and paperboard are assembled with the hinge tape adhered in the groove in the skived region, leaving the tape flush with the surface of the paperboard.

15 Claims, 8 Drawing Figures

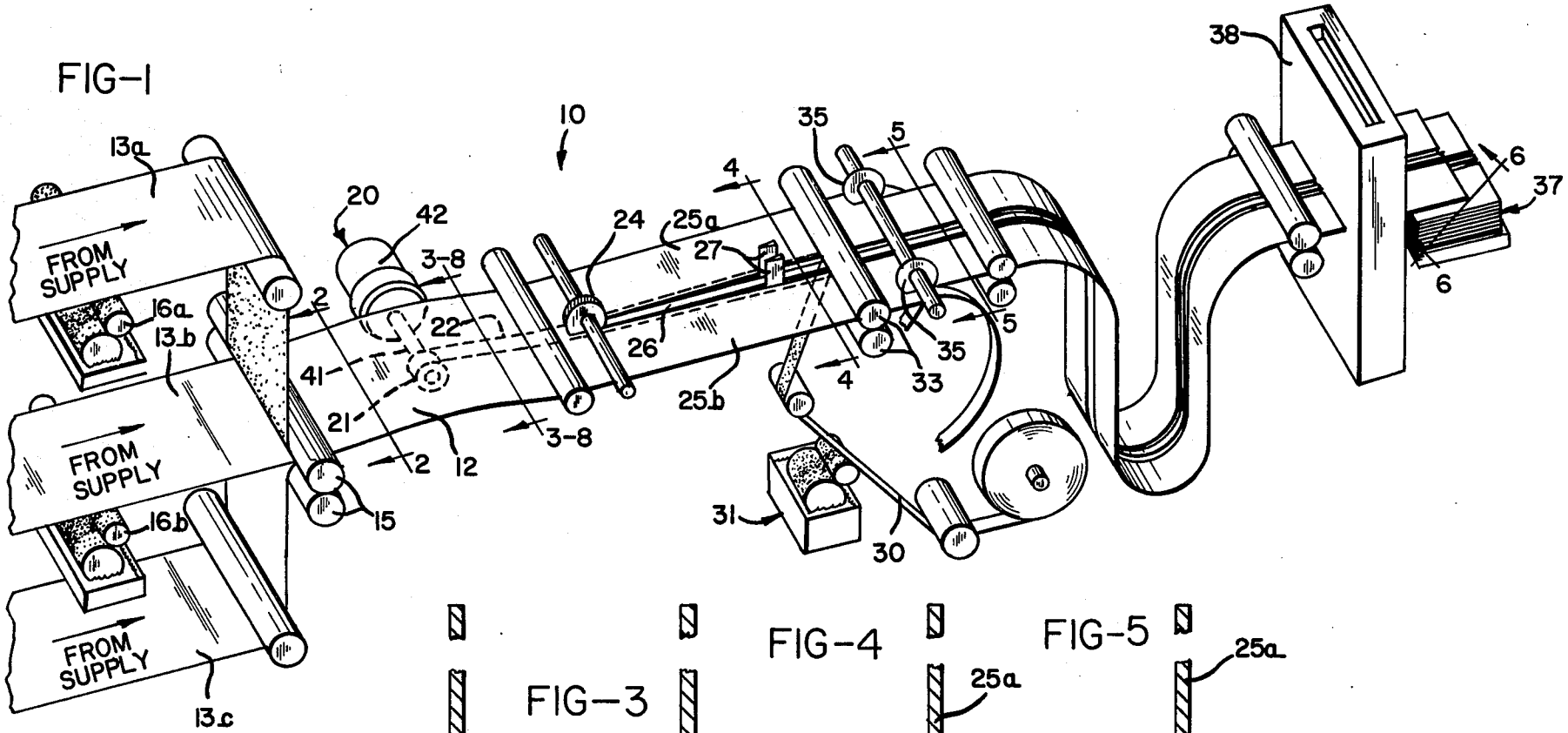
FIG-1
FIG-2
FIG-3
FIG-4
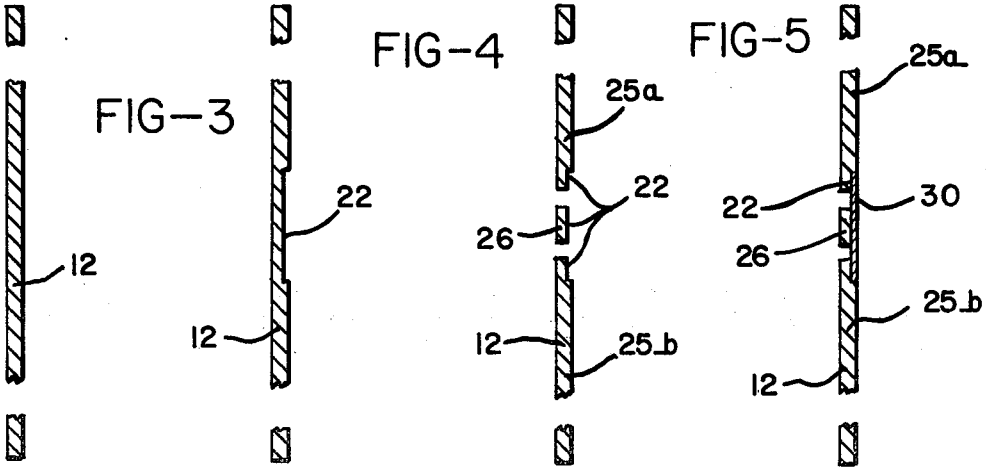
FIG-5

CONTINUOUS FLEXIBLE HINGE FOR PAPERBOARD AND THE LIKE

BACKGROUND OF THE INVENTION

This invention relates to the production of hinged paperboard products, and more particularly to a continuous flexible hinge for paperboard products such as commonly used in the making of book cover blanks.

The prior art provides numerous examples of book cover blanks formed from sheets of paperboard material parallel to and spaced from one another by a distance defining a hinge region, and joined in this region by a thin, flexible hinge material. The webs of hinge material and paperboard are continuously fed and laminated, then cut into discrete lengths to form blanks for book covers and the like. Frequently the leafboard portions are formed by laminating several plys of paperboard for additional thickness and strength. U.S. Pat. Nos. 2,922,172, 3,206,226 and 3,206,349 provide examples wherein the hinge material extends entirely across the book cover blanks, from the outer edge of one leafboard to the outer edge of the other. This is commonly referred to as a full width hinge overlay.

U.S. Pat. Nos. 3,145,033 and 3,199,896 relate to continuous hinged paperboard products in which a narrow hinge material, commonly referred to as a hinge tape, is used in the hinge region. Hinge tapes are often preferred since a more expensive hinge material may be used which is better suited to its function, without wasting such material across the entire width of the paperboard. As pointed out in these patents, however, a hinge tape can produce a hump or bump in the middle of the blank. This can interfere with proper stacking of the blanks and may be visible as a line or ridge after a cover is applied to the blank. One solution, which is discussed in these references, is to deform the paperboards in the region of the hinge tape by compressing them beyond their elastic limits, to form a permanent dent in the paperboards of a depth similar to the thickness of the hinge tape. This is done by compressing the paperboards between rollers, one of which has an integral collar which provides the necessary additional compression in the region of the hinge tape.

While the above prior art practices have provided acceptable results and received wide commercial acceptance, there nevertheless remains a need for greater precision, economy, and flexibility. For example, a full width overlay often requires compromises in the choice of hinge material, lest expenses become too great. A narrower compressed hinge tape requires the use of a special, collared roller, having a collar of exactly the width desired. Such rollers are usually sizeable, can indent only one specific width, may be costly to produce, and take time to change. The flexibility of machines using such collared rollers is thus limited, since it can be expensive to change the width and/or depth of the special compression collar at frequent intervals.

A greater objection to compressing or densifying the paperboard in the hinge tape area is the variable thickness or caliper that results from this type of operation. That is, for a given set of circumstances and the particular machine set up, the resulting hinge/paperboard combination thickness can vary throughout the run depending upon the uniformity of the thickness of the paperboard which is supplied, variations in the moisture content of the paperboard, and variations in the amount of "spring back" after being compressed or densified.

This can also be affected by variables introduced into the paperboard when it was manufactured.

Such variables in the properties of the paperboard result in a lack of precision in controlling the uniformity of the thickness in the hinge area as the book cover product is being manufactured. Even a slight variation in the thickness of the product in the hinge area, when multiplied many times as the book covers are stacked for shipment, can result in an unattractive load which is difficult to package, and difficult to ship with confidence that it will be delivered to the customer in good, undamaged condition.

A need thus remains for a narrow hinge tape configuration, method, and apparatus for continuous flexible hinges for paperboard and the like wherein the hinge tape will be uniformly and reliably flush with the surface of the paperboards, and will provide for easy and rapid set up, adjustments, and changes in the thickness and/or width of the hinge tape material, all at minimum cost.

SUMMARY OF THE INVENTION

Briefly, the present invention fulfills the above needs by skiving or milling away a portion or layer of the leaf board material equal in depth to the thickness of the hinge tape material, and in width to an amount causing the hinge tape to extend from one side to the other of the skived groove. The skiving is done by a small grinding or milling wheel which is easily exchanged for wheels of other widths, as desired, for changing or adjusting the width of the groove. The depth of the groove is regulated by an easily adjusted depth of cut gage which supports the paperboard relative to the milling wheel. The apparatus is thus inexpensive, easy to set up, and can be easily adjusted to accommodate any width or depth which may be desired. The need for specially compressing the paperboard, and the need for special rollers for this purpose, is thus eliminated, and exactly the right depth of material is always and continuously removed.

It is therefore an object of the present invention to provide a method and apparatus for producing a continuous flexible hinge for paperboard and the like, and the hinge produced thereby, in which the hinge material is adhered within a skived or milled groove in the paperboard material to a depth such that the outer surface of the hinge tape is flush with the adjacent surface of the paperboard; in which adjustments in the width and depth of the groove may be readily and economically provided, as by changing a milling wheel or adjusting the position thereof relative to the paperboard; and in which the above objects and purposes may be accomplished inexpensively and reliably, and with the versatility for use in connection with a wide variety of hinged paperboard configurations.

Other objects and advantages of the invention will be apparent from the following description, the accompanying drawings and the appended claims.

BRIEF DESCRIPTION OF THE DRAWINGS

FIG. 1 is a somewhat figurative, schematic illustration of a machine and method for producing book cover blanks in accordance with the present invention;

FIG. 2 is a cross sectional view taken on line 2—2 of FIG. 1;

FIG. 3 is a cross sectional view taken on line 3—3 of FIG. 1;

FIG. 4 is a cross sectional view taken on line 4—4 of FIG. 1;

FIG. 5 is a cross sectional view taken on line 5—5 of FIG. 1;

DESCRIPTION OF THE PREFERRED EMBODIMENT

Figure 7:
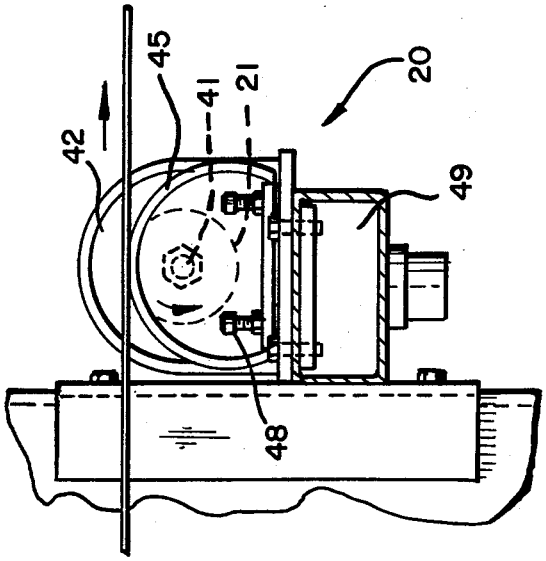
FIG. 7 is a fragmentary, cross sectional view taken generally on line 7—7 of FIG. 8.

Machine 10 illustrated in FIG. 1 provides, in conventional fashion, a stream 12 of paperboard material advanced along a predetermined path through the machine. The paperboard material 12 is of a thickness suitable to the end product desired, and is frequently made by laminating several thinner sheets of such material, such as sheets 13*a*, *b*, and *c*, from a supply thereof (not shown). They are adhered to one another by passing between rollers 15 after they have received a suitable adhesive coating, such as from gluers 16*a* and *b*.

The stream of paperboard material 12 is then pulled across a milling station 20 (shown schematically in FIG. 1, and in detail in FIGS. 7 and 8) where a groove 22 of the desired width and depth is removed, as by cutting, skiving, or milling a thickness of the paperboard material from the underside of the paperboard stream 12 by a grinding, cutting, or milling wheel 21. The groove 22, which is of a predetermined depth and width, is in the region of the paperboard material and thereby provides a hinge region.

The paperboard material is then advanced further along its path to a slitter 24 where it is slit into a plurality of parallel paperboard streams. As illustrated, there are two streams of leafboard material, 25*a* and 25*b*, and a stream of spine reinforcement material 26. These streams are separated a predetermined distance or amount, in well known fashion, and guided into spaced relationship by conventional means such as guides 27.

The hinge tape 30 receives an adhesive coating in gluer 31 and is advanced to the paperboard streams. The hinge tape is positioned within the groove 22 as the leafboard and spine reinforcement streams 25*a*, 25*b*, and 26 and the hinge tape 30 are simultaneously passed between rollers 33. The depth and width of groove 22 have previously been adjusted to the dimensions of the hinge tape, taking into account the spacing between the leafboard streams 25*a* and *b* and the spine reinforcement stream 26. When the hinge tape 30 is then adhered to the paperboard within groove 22, the hinge tape is of substantially the same thickness as the depth of the groove and extends from one side thereof to the other, providing a substantially flush surface with the paperboard. The process is continuous, so that the leafboards, the separation between the leafboards and the spine reinforcement stream, the groove, and the hinge tape, all extend in directions parallel to the direction in which the entire assembly is advanced within machine 10.

Next, the combined stream is advanced through edge trimmers 35 where the outermost edges of the paperboard are trimmed to the desired, predetermined width, prior to severing of the individual book cover blanks 37 in a suitable cutter 38.

Figure 8:
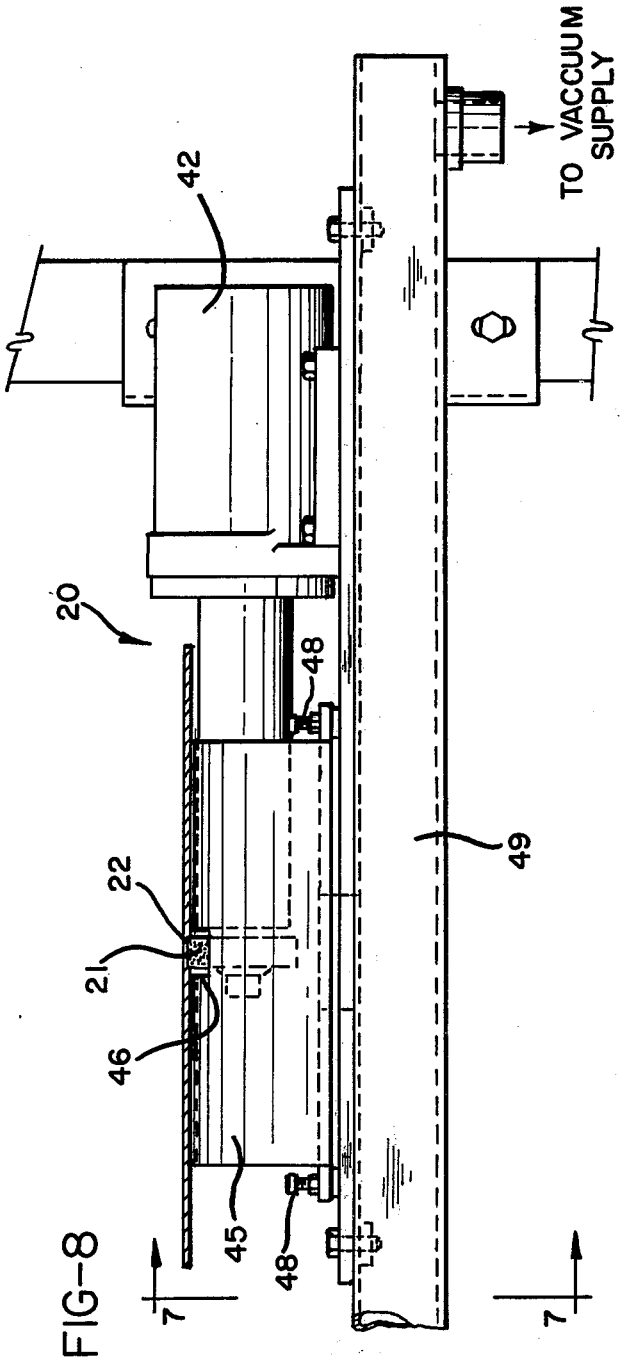
FIG. 8 is a side view of the milling apparatus which cuts the groove in the paperboard stream.
Figure 6:
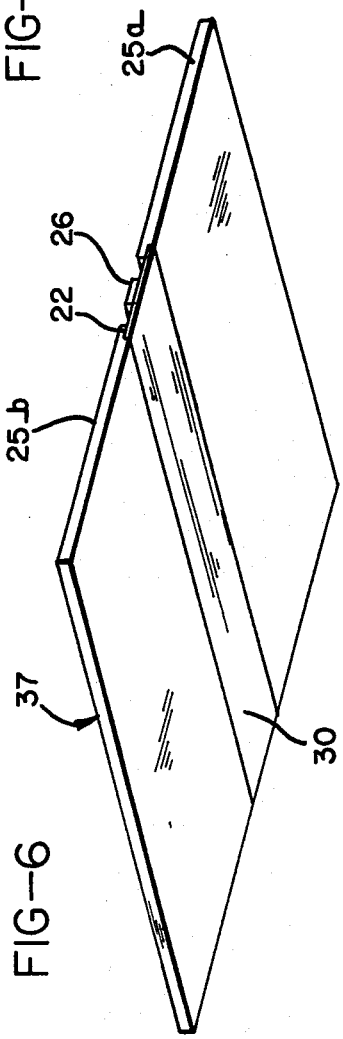
FIG. 6 is a perspective view looking at the bottom of a book cover blank, taken generally in the direction of view line 6—6 of FIG. 1.

With reference to FIGS. 7 and 8, the grinding or cutting wheel 21 is supported and rotated on a shaft 41 of a drive motor 42, and positioned on the underside of the stream 12 of paperboard material. Actually, wheel 21, which may also be considered a type of router, is positioned so that it is not only adjacent to, but actually projects slightly into, the path of the paperboard 12, for engaging the paperboard and removing the desired amount of material therefrom. This is schematically illustrated in FIG. 1 by a slight rising and falling of the paperboard stream 12 in the vicinity of the cutting wheel 21.

Milling station 20 also includes a depth of cut gage 45 which is actually a curved shield surrounding wheel 21. Wheel 21 projects through a slot 46 in the top of gage 45 for engaging and skiving the groove 22 into the paperboard material. The balance of the paperboard material in the vicinity of wheel 21 passes across and is engaged and supported by gage 45, which is also positioned to project into the path of the paperboard adjacent wheel 21. As can be seen in FIG. 8, gage 45 thus limits the degree to which the paperboard stream 12 and wheel 21 may engage one another, so that the exposure of the paperboard to the wheel 21 is restricted to the removal of only the predetermined depth of material.

The motor 42 and wheel 21 are mounted in a fixed position in machine 10. Gage 45, however, is vertically adjustable on jack screws 48 for vertical movement into and out of the path of the paperboard material 12. The top of the gage 45, which functions as a platform to support the paperboard relative to wheel 21, can thus be moved relative to wheel 21 into and out of the paperboard path for regulating and controlling the thickness of the material which is milled or removed by wheel 21 from the stream of paperboard material 12. That is, the thickness of the cut, and hence the depth of groove 22, is determined by adjusting the relative positions of the wheel 21, the platform or top of gage 45, and the paperboard which is supported on the platform. As indicated earlier, the width of the groove is readily adjusted by changing wheel 21 for a wheel of another width.

The material which is removed is vacuumed into the interior of gage 45 and then through a vacuum box 49 to a suitable collection device (not shown).

As may be seen, therefore, the present invention provides numerous advantages. It is inexpensive, highly flexible, and readily suited for use on a wide variety of paperboard fabricating and assembling devices. Changes and adjustments may be quickly and economically made, with a minimum of down time and inconvenience. Rather than compressing the paperboard material with large, bulky, and cumbersome collared rollers, the present invention simply provides a structure wherein all portions of the paperboard, including the parts of the paperboard portions having the groove therein, are equally uncompressed, the grooved parts simply having less thickness and less paperboard material than the remainder of the paperboard portions.

As will be understood, "uncompressed" means that the paperboard does not need to be subjected to any external pressure which would exceed that ordinarily applied to effect bonding as the various webs are laminated. That is, some compression inevitably takes place in rollers 15 and 33, but not of the order caused by the integral collars on prior art rollers. In that sense the paperboard material in the present invention is never substantially compressed, but remains uncompressed throughout, both within and without the grooved region. Even so, the hinge tape in the present invention is flush with the adjacent surfaces of the paperboard material, so that there are no objectionable bumps, thicknesses, creases, or variations in the final product.

While the method, apparatus, and product herein described constitute preferred embodiments of the invention, it is to be understood that the invention is not limited thereto, and that changes may be made therein without departing from the scope of the invention.

What is claimed is:

1. A method for producing a continuous flexible hinge for paperboard and the like suitable for use in making book cover blanks, comprising:
(a) advancing at least one stream of the paperboard along a predetermined path,
(b) processing the material to provide a slitted groove, the groove being formed by removing a thickness of material from the paperboard to provide a groove of predetermined depth along a hinge region of the paperboard, and the paperboard being slit in the direction of advancement thereof to form a plurality of parallel paperboard streams,
(c) separating the streams a predetermined amount, and
(d) adhering a hinge tape to the paperboard within the groove, the hinge tape being of substantially the same thickness as the depth of the groove and extending from one side thereof to the other to provide a substantially flush surface on the paperboard.

2. The method of claim 1 wherein said paperboard is slit subsequent to said removing step, and further comprising slitting the paperboard stream along the groove in the hinge region to provide two parallel leafboard streams and an intermediate spine reinforcement stream.

3. The method of claim 1 further comprising trimming the outermost edges of the paperboard to a predetermined width after the hinge tape has been adhered to the paperboard.

4. The method of claim 1 wherein said removing step further comprises milling the material from the paperboard.

5. The method of claim 4 wherein said milling step further comprises passing the paperboard across a depth of cut gage and supporting the paperboard thereon as it is being milled to regulate and control the thickness of the material which is milled from the paperboard.

6. A method for producing a continuous flexible hinge for paperboard and the like suitable for use in making book cover blanks, comprising:
(a) advancing at least one stream of the paperboard along a predetermined path,
(b) milling a thickness of material from the paperboard by passing the paperboard across a depth of cut gage and supporting the paperboard thereon as it is being milled, to regulate and control the thickness of the material which is milled from the paperboard, and to provide a groove of predetermined depth along a hinge region of the paperboard,
(c) slitting the paperboard stream along the groove in the hinge region, said slitting being done in the direction of advancement of the paperboard to provide two parallel leafboard streams and an intermediate spine reinforcement stream, and separating the streams a predetermined amount, and
(d) adhering a hinge tape to the paperboard within the groove, the hinge tape being of substantially the same thickness as the depth of the groove and extending from one side thereof to the other to provide a substantially flush surface on the paperboard.

7. An apparatus for producing a continuous flexible hinge for paperboard and the like suitable for use in making book cover blanks, comprising:
(a) means for supplying and advancing at least one stream of paperboard along a predetermined path,
(b) means for processing the material to provide a slitted groove, said processing means forming said groove by removing a thickness of material from the paperboard to provide a groove of predetermined depth along a hinge region of the paperboard, and said processing means slitting said paperboard in the direction of advancement thereof to form a plurality of parallel paperboard streams,
(c) means for separating said streams a predetermined amount,
(d) means for supplying a stream of hinge tape of substantially the same thickness as the depth of the groove and of a width substantially the same as the distance from one side of the groove to the other, and
(e) means for adhering said hinge tape to the paperboard within said groove to provide a substantially flush surface on the paperboard.

8. The apparatus of claim 7 wherein said processing means includes slitting means for slitting said paperboard and removing means for removing said thickness of material, said slitting means being located between said removing means and said hinge tape adhering means, and further comprising means for slitting said paperboard stream along said groove in said hinge region to provide two parallel leafboard streams and an intermediate spine reinforcement stream.

9. The apparatus of claim 7 further comprising means subsequent to said adhering means for trimming the outermost edges of the paperboard to a predetermined width.

10. The apparatus of claim 7 wherein said processing means includes milling means for removing said thickness of material from said paperboard.

11. The apparatus of claim 10 further comprising:
(a) means mounting said milling means adjacent and projecting into said paperboard path for engaging said paperboard and removing said thickness therefrom, and
(b) means projecting into said paperboard path and supporting said paperboard in the vicinity of said milling means to control the exposure of said paperboard to said milling means for restricting the milling operation to the removal of only said predetermined depth of material.

12. The apparatus of claim 11 wherein said paperboard supporting means further comprises a platform supporting said paperboard on either side of said milling means, and means adjustably supporting said platform for movement relative to said milling means into and out of said paperboard path for adjusting the thickness of material removed from said paperboard by adjusting the relative positions of the milling means, the platform, and the paperboard supported on said platform.

13. An apparatus for producing a continuous flexible hinge for paperboard and the like suitable for use in making book cover blanks, comprising:
(a) means for supplying and advancing at least one stream of paperboard along a predetermined path,
(b) milling means for removing a thickness of material from the paperboard to provide a groove of predetermined depth along a hinge region of the paperboard, (c) means mounting said milling means adjacent and projecting into said paperboard path for engaging said paperboard and removing said thickness therefrom, (d) platform means projecting into said paperboard path and supporting said paperboard in the vicinity of and on either side of said milling means, to control the exposure of said paperboard to said milling means for restricting the milling operation to the removal of only said predetermined depth of material, (e) means adjustably supporting said platform for movement relative to said milling means into and out of said paperboard path for adjusting the thickness of material removed from said paperboard by adjusting the relative positions of the milling means, the platform, and the paperboard supported on said platform, (f) means for slitting said paperboard stream along said groove in said hinge region, said slitting means slitting said paperboard in the direction of advancement thereof to provide two parallel leafboard streams and an intermediate spine reinforcement stream, and separating said streams a predetermined amount, (g) means for supplying a stream of hinge tape of substantially the same thickness as the depth of the groove and of a width substantially the same as the distance from one side of the groove to the other, (h) means for adhering said hinge tape to the paperboard within said groove to provide a substantially flush surface on the paperboard, and (i) means for trimming the outermost edges of the paperboard to a predetermined width.

14. A flexible hinge for paperboard and the like suitable for use in a book cover blank, comprising:

(a) a plurality of parallel portions of paperboard separated by a predetermined amount, (b) means defining a groove of predetermined depth in said paperboard portions and extending across a part of each said portion in a direction parallel to the separation therebetween, all portions of said paperboard, including the parts having said groove therein, being substantially equally uncompressed, the grooved parts having less thickness and less paperboard material than the remainder of said portions, and (c) a hinge tape adhered to the paperboard portions within said groove, said hinge tape being of substantially the same thickness as the depth of the groove and extending from one side thereof to the other to provide a substantially flush surface on the paperboard.

15. The hinge of claim 14 wherein said paperboard portions further comprise two parallel leafboard portions and an intermediate spine reinforcement portion.

* * * * *